US008584312B2

(12) United States Patent
Fuchigami et al.

(10) Patent No.: US 8,584,312 B2
(45) Date of Patent: Nov. 19, 2013

(54) CLEANING APPARATUS AND CLEANING METHOD

(75) Inventors: Akihiro Fuchigami, Kanagawa (JP); Tatsuya Satoh, Tokyo (JP); Yoichi Okamoto, Kanagawa (JP); Yuusuke Taneda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 554 days.

(21) Appl. No.: 12/484,574

(22) Filed: Jun. 15, 2009

(65) Prior Publication Data

US 2009/0314312 A1 Dec. 24, 2009

(30) Foreign Application Priority Data

Jun. 18, 2008 (JP) ..... 2008-158618
May 1, 2009 (JP) ..... 2009-111799

(51) Int. Cl.
*A47L 5/14* (2006.01)
*A47L 9/10* (2006.01)
*A47L 9/04* (2006.01)

(52) U.S. Cl.
USPC ..... 15/345; 15/347; 15/363

(58) Field of Classification Search
USPC ..... 15/303, 306.1, 346, 345, 347, 363; 134/89, 201, 165, 110, 102.1
See application file for complete search history.

(56) References Cited

U.S. PATENT DOCUMENTS 1,910,497 A * 5/1933 Peik ..... 451/89
2,649,757 A * 8/1953 Diamond ..... 118/404
2,657,409 A * 11/1953 Dawson ..... 15/104.04
3,508,997 A * 4/1970 McKenney Werling ..... 156/389
5,265,298 A 11/1993 Young
5,417,608 A * 5/1995 Elliott ..... 451/81
7,743,776 B2 * 6/2010 Okamoto et al. ..... 134/93
2007/0107752 A1 * 5/2007 Fuchigami et al. ..... 134/21
2007/0283980 A1 12/2007 Okamoto et al.
2008/0052953 A1 3/2008 Okamoto et al.
2008/0141484 A1 6/2008 Satoh et al.
2009/0095160 A1 * 4/2009 Troxell et al. ..... 96/15
2009/0139842 A1 * 6/2009 Simoens ..... 198/823

FOREIGN PATENT DOCUMENTS

CN 101031370 A 9/2007
EP 0 316 622 A2 5/1989
EP 0 316 622 A3 5/1989
EP 1 782 895 A1 5/2007
EP 1 897 628 A2 3/2008
JP 7-316858 12/1995

(Continued)

*Primary Examiner* — Eric Golightly
*Assistant Examiner* — Arlyn I Rivera-Cordero
(74) *Attorney, Agent, or Firm* — Oblon, Spivak, McClelland, Maier & Neustadt, L.L.P.

(57) ABSTRACT

A cleaning apparatus for cleaning an object to be cleaned by allowing a cleaning medium caused to fly by an air flow to collide with the object to be cleaned is provided. The cleaning apparatus includes a cleaning tank in which the cleaning medium is caused to fly by the air flow and which has an opening to allow the object to be cleaned to pass through; a cleaning medium accelerating part provided at a bottom part of the cleaning tank and to inject the air flow to cause the cleaning medium to fly; a hollow elongated member having substantially the same inner diameter as a diameter of the opening, connected outside the opening, and configured to form a movement path for the object to be cleaned; and a cleaning medium returning part to return the cleaning medium stagnant in the hollow elongated member into the cleaning tank.

8 Claims, 16 Drawing Sheets

(56) References Cited

FOREIGN PATENT DOCUMENTS

| | | |
|---|---|---|
| JP | U 2515833 | 8/1996 |
| JP | 10-34100 | 2/1998 |
| JP | 2791862 | 6/1998 |
| JP | A 2007-029945 | 2/2007 |
| JP | A 2007-144395 | 6/2007 |
| JP | A 2008-062144 | 3/2008 |
| WO | WO 2006/137264 A1 | 12/2006 |

* cited by examiner

CLEANING APPARATUS AND CLEANING METHOD

BACKGROUND OF THE INVENTION

1. Field of the Invention

The present invention generally relates to a cleaning apparatus and a cleaning method which is used in an electrophotographic type image forming apparatus such as a copier or a laser printer to remove deposits such as dust or an extraneous substance attached or fixed on a component having a complicated shape by using a solid cleaning medium. More specifically, the present invention provides an effective technique to efficiently clean a long and thin object to be cleaned.

2. Description of the Related Art

To realize a society with an environmentally-sound material cycle, business equipment manufacturers of copiers, facsimile machines, or printers actively practice recycling activities. In the activities, they collect used products or various units from users, and then disassemble, clean, and reassemble them so as to be used as components or a resin material. In order to reuse components used in these products or various units, a step of removing toner, which is minute particles, attached on the disassembled components or units has been required. Thus, it has been a great challenge to reduce cost and environmental load.

For the cleaning, in general, a wet-type cleaning method has been often employed, such as an ultrasonic wave cleaning method to dip the components or units in a water tank and apply ultrasonic waves, and a shower cleaning method to direct a high speed stream of water to an object to be cleaned by using a nozzle. When such a wet-type cleaning method is used to clean the components or units on which a stain of toner and the like are attached, processing of a waste solution including the toner and the like and a drying process after the cleaning consume a large amount of energy and are very costly.

On the other hand, a dry-type cleaning method using an air blow does not exhibit a sufficient cleaning performance with respect to toner and the like that have a strong attaching force. Therefore, a post-step of wiping with a waste cloth by hand and the like have been required. In this manner, cleaning has been one of the bottleneck steps in reusing and recycling the products.

To solve the above-described problems, a cleaning apparatus disclosed in Patent Document 1 flows air in a cleaning tank, causing lightweight, solid, and easy-to-fly cleaning media to fly in the cleaning tank, so that the cleaning media continuously contact an object to be cleaned, and a deposit attached on the object to be cleaned (attached dust, powder, or a stain fixed in a film state on the object to be cleaned) is separated without using water. In particular, by using cleaning media in flexible thin pieces, a cleaning performance equivalent to or more than the ultrasonic wave cleaning method can be exhibited even with a small amount of the cleaning media.

Moreover, there has been known a method to clean a whole surface of the object to be cleaned without using a cleaning tank for storing the object to be cleaned. By this method, the whole surface of the object to be cleaned is cleaned by removing an extraneous substance in a small spot area of the object by using a blast gun and the like and scanning a blowing position of the blast gun over the object to be cleaned. For example, a cleaning apparatus disclosed in Patent Document 2 causes flying substances formed of a sponge or a rubber sphere having a hollow center, which have a diameter of about 10 to 30 mm, to fly in a cone shaped housing by using compressed air, so as to collide with and clean a spot area of the object to be cleaned.

[Patent Document 1] Japanese Patent Application Publication No. 2007-29945

[Patent Document 2] Japanese Utility Model Registration No. 2515833

The dry-type cleaning apparatus as disclosed in Patent Document 1 employs a method to put the object to be cleaned in the cleaning tank so as to be collided with cleaning media. Therefore, a cleaning tank that has a volume equal to or more than the size of the object to be cleaned has been required to be prepared. Because of this, it has been difficult to clean a large object to be cleaned. Moreover, when various components in different sizes are to be cleaned by one cleaning apparatus, a cleaning tank and process conditions have had to be adjusted for the largest component. In this case, when a small object to be cleaned is put in the cleaning tank, it is inefficient since flying cleaning media which do not contribute to cleaning are increased. Further, since an optimum cleaning condition changes depending on the size of the object to be cleaned, there have been problems in that it has been troublesome to adjust the condition in cleaning various kinds of objects, and quality of the cleaning is not consistent.

In the cleaning method disclosed in Patent Document 2, the inside of the housing has a positive pressure. Therefore, it has been difficult to prevent leakage of the small and flexible flying media. Moreover, this cleaning method is more suitable for cleaning a plane surface. In the case of cleaning an object having a three-dimensionally complicated shape, there is usually a space formed between the housing and the object to be cleaned. Thus, it has been difficult to perform cleaning without leaking the cleaning medium. When the cleaning medium is leaked, there have been problems in that an operation environment is polluted, and at the same time, the number of cleaning media flying in the housing is decreased and that the cleaning performance is degraded.

According to at least one embodiment, the present invention is made to improve such disadvantages and provides a cleaning apparatus and a cleaning method which can efficiently clean even an object to be cleaned having a complicated surface shape, by causing cleaning media to fly in a cleaning tank without stagnation as well as by downsizing the volume of the cleaning tank.

Further, according to at least one embodiment, the present invention is made to obtain a consistent cleaning performance by effectively using cleaning media by quickly collecting the cleaning media into the cleaning tank when the cleaning media leak from the space in the cleaning tank where the cleaning medium fly.

SUMMARY OF THE INVENTION

According to one aspect of the present invention, a cleaning apparatus for cleaning an object to be cleaned by allowing a cleaning medium caused to fly by an air flow to collide with the object to be cleaned includes a cleaning tank in which the cleaning medium is caused to fly by the air flow and which has an opening configured to allow the object to be cleaned to pass through; a cleaning medium accelerating part provided at a bottom part of the cleaning tank and configured to inject the air flow to cause the cleaning medium to fly; a hollow elongated member configured to have substantially the same inner diameter as a diameter of the opening of the cleaning tank, connected outside the opening of the cleaning tank, and configured to form a movement path for the object to be cleaned; and a cleaning medium returning part configured to return the cleaning medium stagnant in the hollow elongated member into the cleaning tank.

According to another aspect of the present invention, a method for cleaning an object to be cleaned by colliding a cleaning medium caused to fly by an air flow with the object to be cleaned in a cleaning tank having an opening through which the object to be cleaned can pass through is provided. The method includes the steps of sucking air in the cleaning tank; inserting the object to be cleaned into the cleaning tank through a cylindrical movement path for the object to be cleaned, said cylindrical movement path having the substantially same inner diameter as a diameter of the opening and being connected outside the opening; and injecting an air flow into the cleaning tank in which the object to be cleaned is inserted so as to cause the cleaning medium to fly.

DETAILED DESCRIPTION OF THE PREFERRED EMBODIMENTS

Figure 1A:
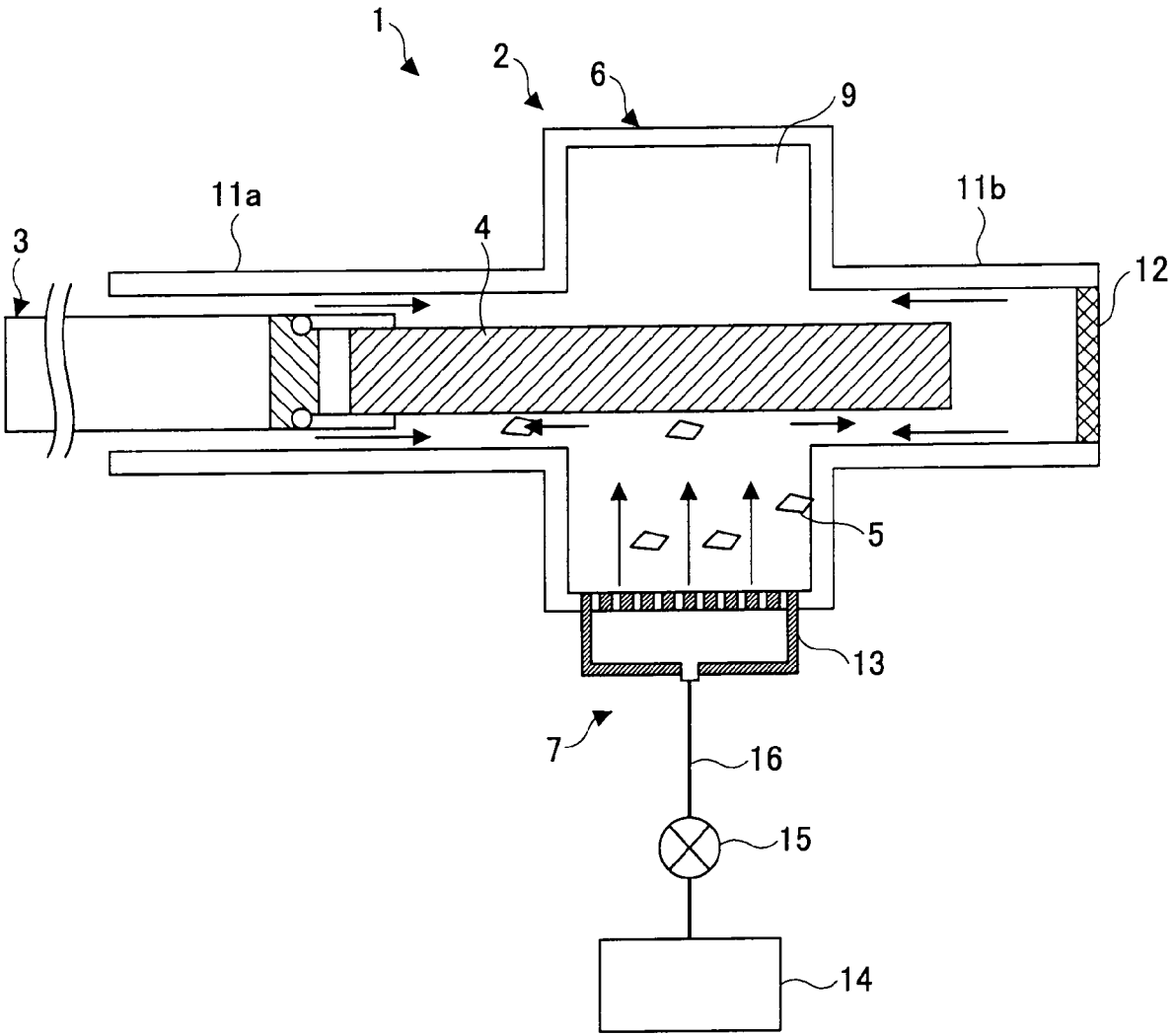
FIGS. 1A and 1B are configuration diagrams of a cleaning apparatus of the present invention.
Figure 1B:
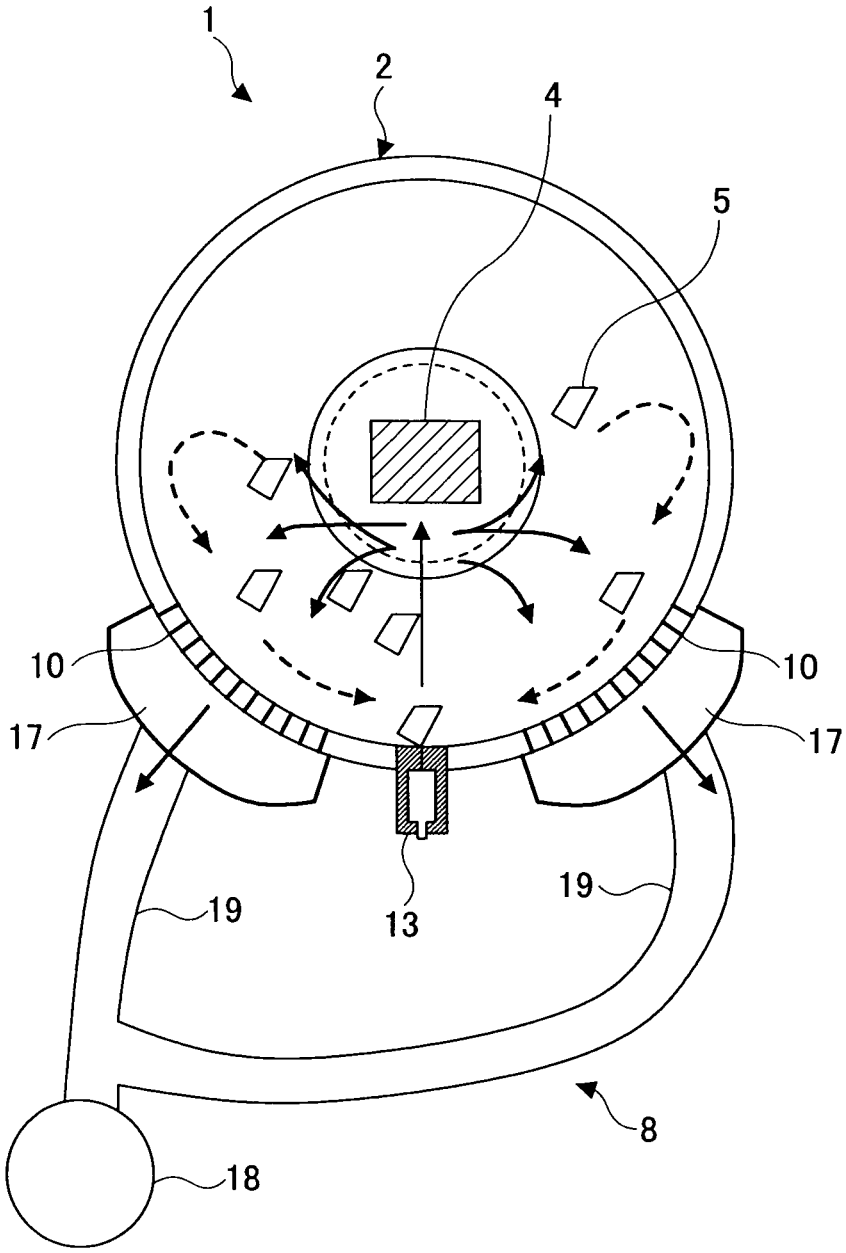

FIGS. 1A and 1B show configurations of a cleaning apparatus 1 of the present invention. FIGS. 1A and 1B show a front cross-sectional view and a side cross-sectional view of the cleaning apparatus 1, respectively. The cleaning apparatus 1 includes a cleaning tank unit 2, a holding part 3, a cleaning medium accelerating part 7, and a suction part 8. In this cleaning apparatus 1, a deposit (dust, powder, or a stain fixed in a film state) attached on an object 4 to be cleaned that is held by the holding part 3 is removed by colliding cleaning media 5 caused to fly by an air flow supplied by the cleaning medium accelerating part 7 with the object to be cleaned. The removed deposit is exhausted outside the cleaning tank unit 2 by the suction part 8.

The cleaning medium 5 used in the cleaning apparatus 1 is formed of a thin piece material in a square shape having a side of 5 to 10 mm and a thickness of 0.1 to 0.2 mm, by using any flexible material having resistance against shock, such as ceramic, cloth, paper, and resin. In some cases, it is effective to change the size or material of the cleaning medium 5 depending on the object 4 to be cleaned. Appropriate conditions for the cleaning medium 5 can be selected in accordance with the object 4 to be cleaned, without being limited to the above-described conditions.

In this manner, when a force of an air flow is applied to the cleaning medium 5 having a thin piece shape in a direction where a projection area is larger, the cleaning medium 5 is easily accelerated and caused to fly because the cleaning medium 5 having a thin piece shape has quite a small mass with respect to air resistance. Moreover, the cleaning medium 5 has low air resistance in a direction where the projection area is small. When the cleaning medium 5 flies in that direction, a high speed movement is maintained for a long distance. Therefore, the cleaning medium 5 has a high energy and a large effect when contacted with the object 4 to be cleaned. Thus, the deposit (dust, powder, or a stain fixed in a film state) attached on the object 4 to be cleaned can be effectively removed. By repeating circulation of the cleaning medium 5, the cleaning medium 5 contacts the object 4 to be cleaned more frequently. Therefore, a cleaning efficiency of the cleaning apparatus 1 can be enhanced.

In addition, air resistance of the cleaning medium 5 having a thin piece shape largely changes depending on its posture. Therefore, the cleaning medium 5 repeatedly contacts the object 4 to be cleaned by moving in a complicated way such as rapidly changing directions as well as moving along the air flow. Therefore, a high cleaning performance can be exhibited for the object 4 to be cleaned, having a relatively complicated shape.

The cleaning tank unit 2 includes a cleaning tank 6, separating parts 10, and hollow elongated members 11*a* and 11*b*. The cleaning tank 6 includes the cleaning medium accelerating part 7, and the separating parts 10. The cleaning tank 6 is formed so that a cleaning medium flying space 9 in the cleaning tank 6 has, for example, a cylindrical shape. Opposing end parts of the cleaning medium flying space 9 are sealed with opposing side walls, and circular openings each having such a diameter that allows the object 4 to be cleaned to pass through are provided at centers of the opposing side walls. The separating parts 10 are formed of a porous member such as a wire mesh, a plastic mesh, a mesh, a perforated metal, or a slit plate, having small apertures or slits which allow gas or a deposit (dust, powder, or a stain fixed in a film state) to pass through but does not allow the cleaning medium 5 to pass through. The separating parts 10 are formed of the above-described member in a smooth shape such as a semi-cylindrical shape, which does not stagnate the cleaning medium 5, at parts of a wall of the cylindrical shape of the cleaning tank 6 with a predetermined distance provided from the bottom-most part of the cleaning tank 6. The hollow elongated members 11*a* and 11*b* have the same inner diameters as the openings provided at the centers of the opposing side walls of the cleaning tank 6. The hollow elongated members 11*a* and 11*b* are formed of cylinders having predetermined lengths and connected outside the respective openings of the opposing side walls of the cleaning tank 6 to form a movement path of the object 4 to be cleaned. On the other hand, an opening end of the hollow elongated member 11*b*, which is at the opposite side to the cleaning tank 6, is covered with a porous member 12 having a mesh or slits that allows an air flow to pass through but does not allow the cleaning medium 5 to pass through.

The cleaning medium accelerating part 7 includes a cleaning medium accelerating nozzle 13 having plural injecting holes, a compressed air supplying apparatus 14 formed of a compressor, a control valve 15, and an airline 16. The cleaning medium accelerating nozzle 13 has the plural injecting holes aligned in a straight line at a bottom surface of the cleaning tank 6, passing through the cleaning tank 6. The compressed air supplying apparatus 14 supplies compressed air through the airline 16 having the control valve 15 to the cleaning medium accelerating nozzle 13 to cause the nozzle 13 to inject an air so that the cleaning media 5 fly. The control valve 15 controls the compressed air supplied by the compressed air supplying apparatus 14. The airline 16 supplies the compressed air supplied from the compressed air supplying apparatus 14 to the cleaning medium accelerating nozzle 13.

The suction part 8 includes suction ducts 17, a suction pipe 19, and a suction apparatus 18. The suction ducts 17 remove dust or a deposit (dust, powder, or a stain fixed in a film state) included in the air in the cleaning tank 6 or attached on the cleaning medium 5 by the separating parts 10 and sucks them. The suction apparatus 18 sucks the air and/or the deposit in the cleaning tank 6 through the suction pipe 19. The suction pipe 19 carries the air and/or deposit, and the like sucked by the suction ducts 17 through the separating parts 10.

Figure 2:
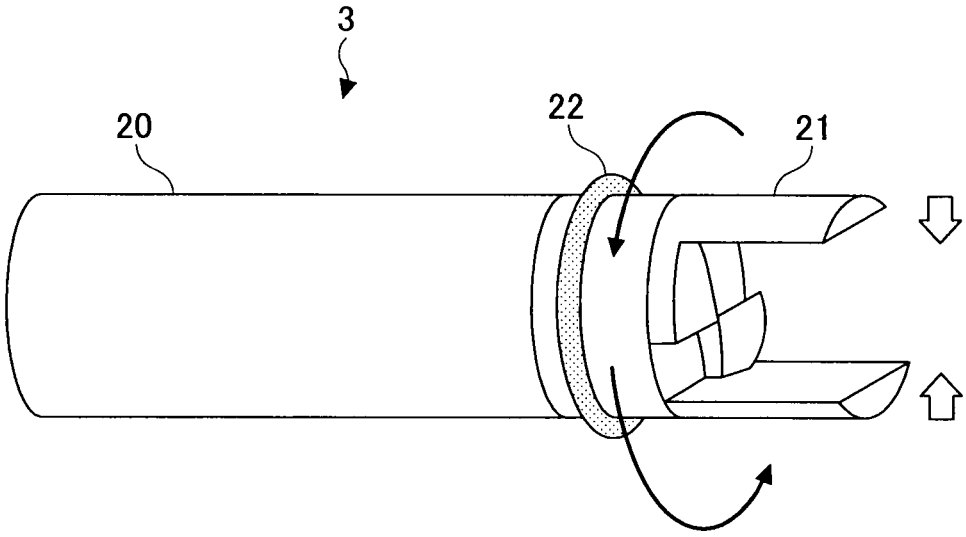
FIG. 2 is a perspective view showing a configuration of a holding part.

As shown in a perspective view of FIG. 2, the holding part 3 includes a cylindrical linear acting arm 20 having an inner diameter slightly smaller (for example, an outer diameter smaller by about several millimeters) than the openings of the hollow elongated members 11*a* and 11*b*, and a grip part 21 provided rotatably at a leading end of the linear acting arm 20. The grip part 21 is provided with a scraper part 22 formed of a mesh, slits, or a dense brush that allows an air flow pass through to a peripheral surface but does not allow the cleaning medium 5 to pass through, so as to internally contact inner surfaces of the hollow elongated member 11*a*.

An operation to remove a deposit (powder or dust) attached on the object 4 to be cleaned by the cleaning apparatus 1 of the present invention is described below.

The cleaning apparatus 1 drives the suction apparatus 18 at all times to suck air in the cleaning tank 6 from the suction ducts 17 through the separating parts 10. The opening of the hollow elongated member 11*a* and the porous member 12 of the hollow elongated member 11*b* generate a suction air flow directed into the cleaning tank 6. In this state, an operator grips the object 4 to be cleaned by the grip part 21 of the holding part 3, and inserts the holding part 3 by which the object 4 to be cleaned is held, through the opening of the hollow elongated member 11*a*, to insert the object 4 to be cleaned into the cleaning tank 6. When the object 4 to be cleaned held by the holding part 3 reaches the cleaning medium flying space 9, the compressed air supplying apparatus 14 which constitutes the cleaning medium accelerating part 7 is driven. While driving the compressed air supplying apparatus 14, the control valve 15 is opened to supply the compressed air to the cleaning medium accelerating nozzle 13, and an air flow is generated perpendicularly upward in the cleaning medium flying space 9 from the cleaning medium accelerating nozzle 13. By this air flow, the cleaning media 5 fly and a part of them collide with the object 4 to be cleaned, thereby a deposit attached on the surface of the object 4 to be cleaned is efficiently removed.

A part of the cleaning media 5 which have collided with the object 4 to be cleaned fly in a direction of the movement path of the hollow elongated members 11*a* and 11*b* while the others fly radially to ultimately reach an inner wall of the cleaning tank 6. Further, the cleaning media 5 which have not collided with the object 4 to be cleaned fly straight as they are and collide with a ceiling of the cleaning tank 6. Here, in the vicinity of an inner wall of the cleaning tank 6, the compressed air supplied by the cleaning medium accelerating part 7 flows along an inner wall of the cylinder perpendicularly crossing the opposing side walls of the cleaning tank 6, and at the same time, a circulation air flow is generated by an air flow sucked by the suction apparatus 18 to flow to the bottom surface of the cleaning tank 6. Therefore, most of the cleaning media 5 which have reached the inner wall of the cleaning tank 6 fall due to the circulation air flow and gravity, and slide down to the vicinity of the cleaning medium accelerating nozzle 13 over the separating part 10. A centrifugal force by the circulation air flow is applied to the cleaning media 5 moving along the inner wall of the cylinder of the cleaning tank 6. Therefore, a probability that the object 4 to be cleaned moves from the openings at the centers of the opposing side walls of the cleaning tank 6 into the hollow elongated members 11*a* and 11*b* is decreased. Therefore, although a large amount of cleaning media 5 fly in the cleaning tank 6, a leakage of the cleaning media 5 into the hollow elongated members 11*a* and 11*b* is suppressed. A part of the cleaning media 5 which have leaked into the hollow elongated members 11*a* and 11*b* is reduced in speed or sucked by an air flow generated in the hollow elongated members 11*a* and 11*b* by the suction of the suction apparatus 18 to be collected into the cleaning tank 6. Further, another part of the cleaning media 5 which have leaked into the hollow elongated member 11*a* is prevented by the scraper part 22 of the holding part 3 to be collected into the cleaning tank 6. In this manner, the cleaning media 5 can be effectively used and a cleaning efficiency can be improved. Moreover, it can be prevented that the cleaning media 5 are leaked outside from the movement path of the object 4 to be cleaned, which is formed of the hollow elongated member 11*a*.

While the cleaning media 5 slide down to the vicinity of the cleaning media accelerating nozzle 13 by being sucked over the separating part 10, a deposit is separated and sucked from the cleaning media 5 when passing through the separating part 10. The deposit separated by the separating part 10 is collected by the suction apparatus 19 through the suction duct 17 and the suction pipe 19. Moreover, the cleaning media 5 which have reached the vicinity of the cleaning media accelerating nozzle 13 is caused to fly again in a perpendicular upward direction by an air flow injected by the cleaning media accelerating nozzle 13. By repeating this operation, a deposit attached on the surface of the object 4 to be cleaned is removed.

While cleaning the object 4 to be cleaned by using the flying cleaning media 5, the linear acting arm 20 of the holding part 3 is rotated to rotate the object 4 to be cleaned, and at the same time the linear acting arm 20 is moved back and forth so as to clean a whole surface of the object 4 to be cleaned. By rotating and moving back and forth the object 4 to be cleaned by the holding part 3 in this manner, the whole surface of the object 4 to be cleaned having a long size can be surely cleaned.

When the cleaning medium 5 is caused to fly by the cleaning medium accelerating nozzle 13 to clean the object 4 to be cleaned, it is more effective to repeat injecting and stopping of an air flow from the cleaning medium accelerating nozzle 13 by intermittently driving the control valve 15. By repeating injecting and stopping of the air flow in this manner, the cleaning media 5 which have entered the hollow elongated members 11*a* and 11*b* can be surely collected into the cleaning tank 6 by a suction air flow generated in the hollow elongated members 11*a* and 11*b* by suction of the suction apparatus 18. Further, by rotating the object 4 to be cleaned at a high speed by using a posture changing function of the holding part 3 when the cleaning medium accelerating nozzle 13 is not injecting an air flow, a centrifugal force is applied to the cleaning media 5. Therefore, the cleaning media 5 can be more reliably separated from the object 4 to be cleaned.

In this manner, by circulating the cleaning media 5 in the cleaning medium flying space 9 by suppressing a leakage of the cleaning media 5 from the cleaning tank 6 so as to collide with the object 4 to be cleaned at a high frequency, a cleaning performance can be enhanced. Moreover, by moving the object 4 to be cleaned straight so as to be taken in and out the cleaning tank 6, the object 4 to be cleaned with a size equal to or larger than the cleaning tank 6 can be cleaned even when the cleaning tank 6 has a small volume. Moreover, by configuring the cleaning tank 6 to have a smaller volume, a flying density of the cleaning media 5 can be increased. As a result, a cleaning performance can be considerably improved compared to a conventional cleaning tank.

Figure 3A:
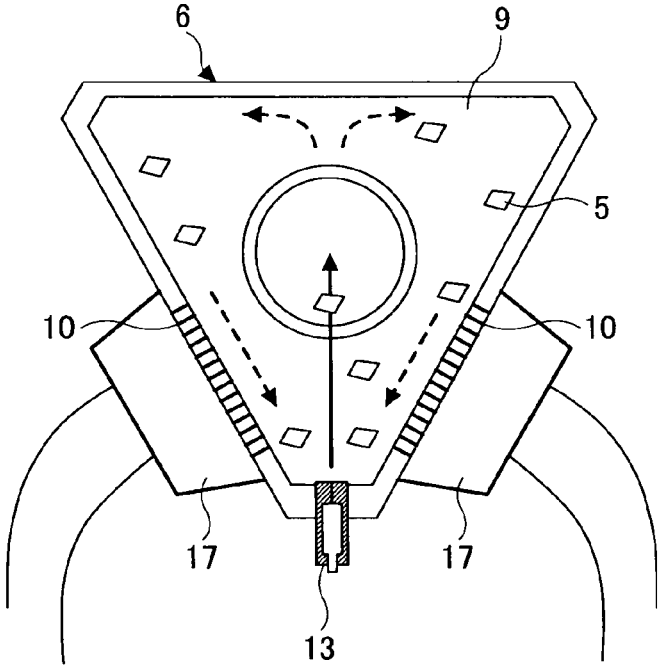
FIGS. 3A to 3D are cross-sectional views showing other shapes of cleaning tanks.
Figure 3B:
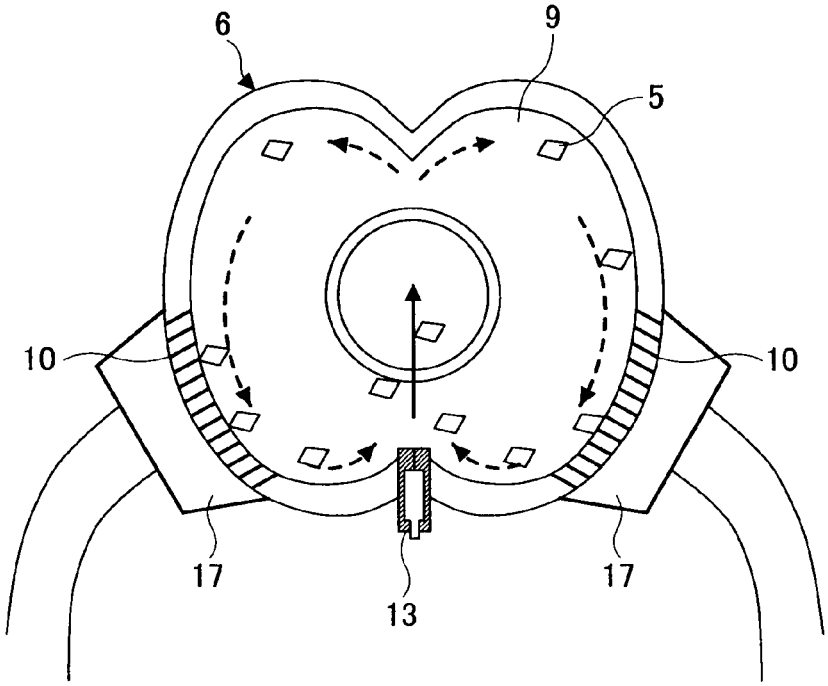
Figure 3C:
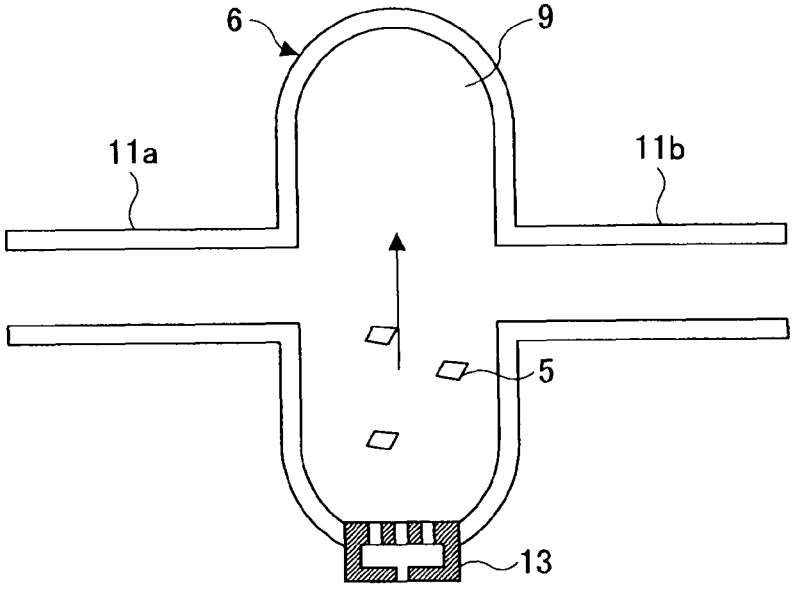
Figure 3D:
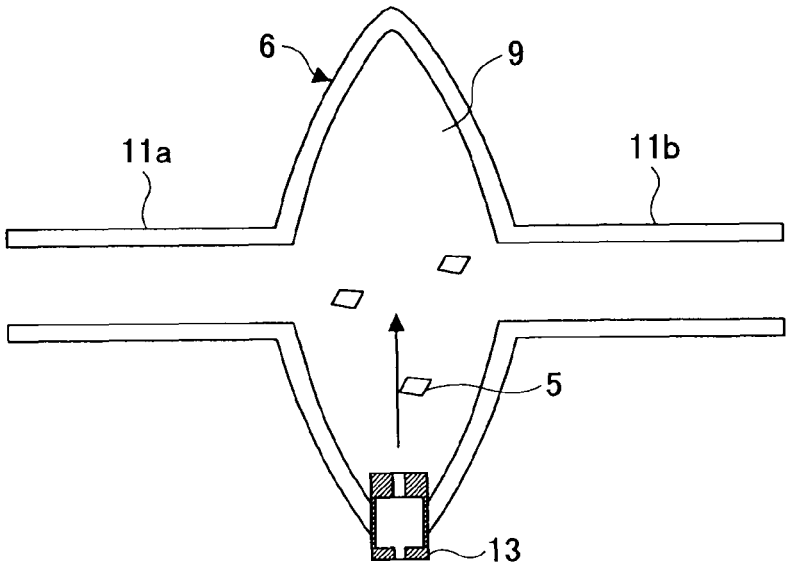

The description has been made of the case where the cleaning tank 6 is formed in a cylindrical shape. However, the shape of the cleaning tank 6 is not limited to the cylindrical shape as long as the cleaning media 5 circulate along opposing side walls and an inner wall perpendicularly crossing the side walls of the cleaning tank 6 and moves to the position of the cleaning medium accelerating nozzle 13 without stagnation. For example, the cleaning tank 6 may have a front cross-section in a prism shape as shown in FIG. 3A or a ∞-shape which is along a convection flow as shown in FIG. 3B, or a side cross-section in a U-shape as shown in FIG. 3C or a V-shape as shown in FIG. 3D.

Figure 4:
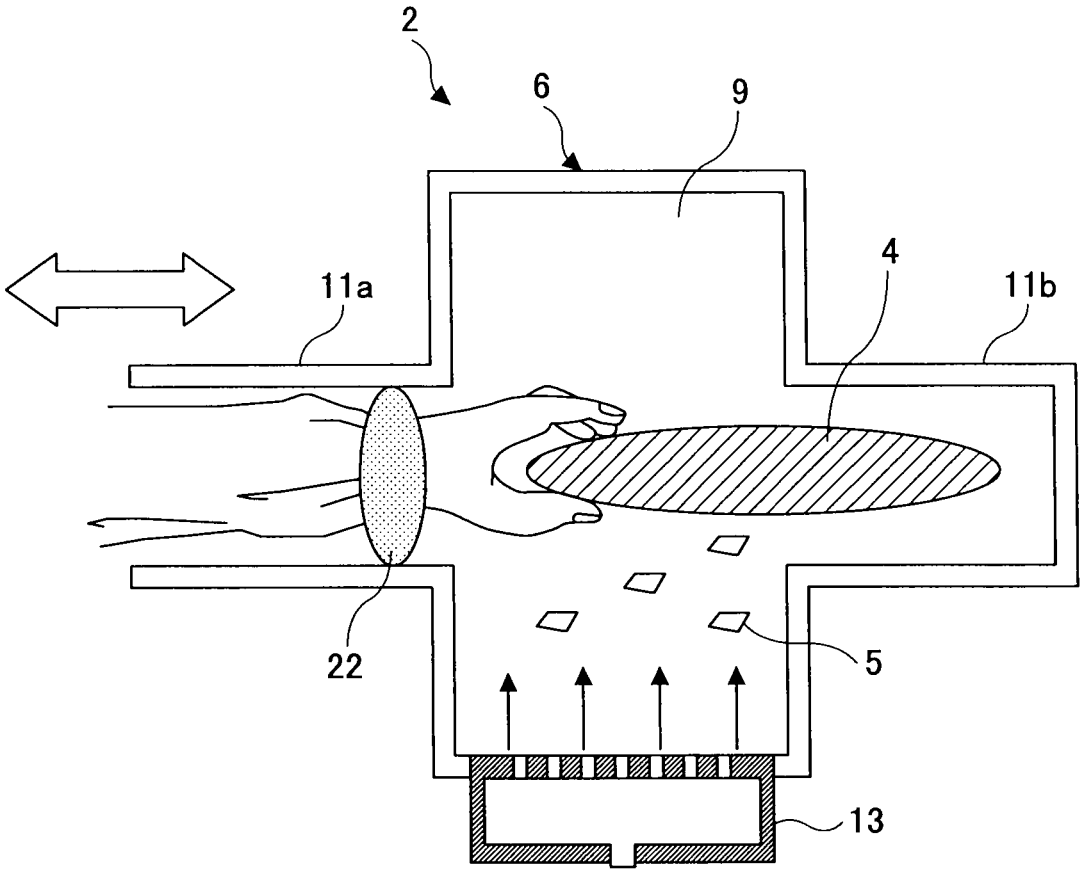
FIG. 4 is a cross-sectional view showing a state where an object to be cleaned is held by a hand of an operator.

The holding part 3 may have any configuration as long as it can hold the object 4 to be cleaned and change the posture of the held object 4 to be cleaned. As shown in FIG. 4, the object 4 to be cleaned may be directly held by an operator. When the operator holds the object 4 to be cleaned in this manner, a leakage of the cleaning media 5 can be more effectively prevented when the scraper part 22 is mounted on a wrist of the operator.

Figure 5A:
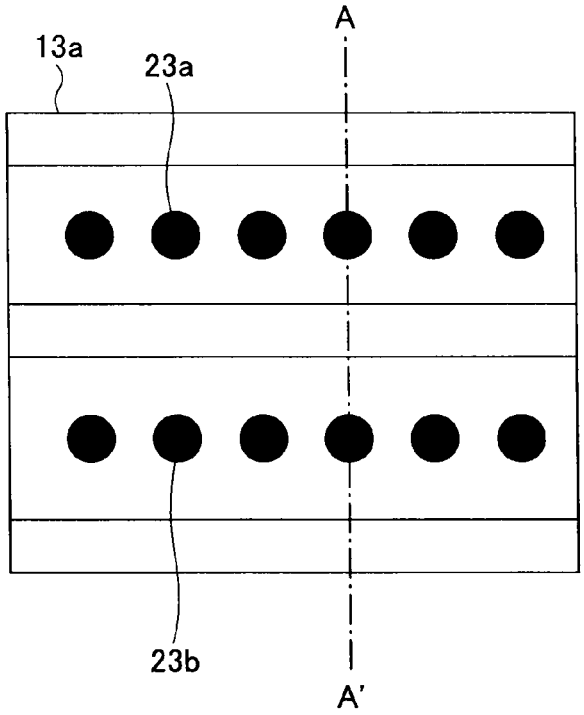
FIGS. 5A and 5B are configuration diagrams of a cleaning medium accelerating nozzle.
Figure 5B:
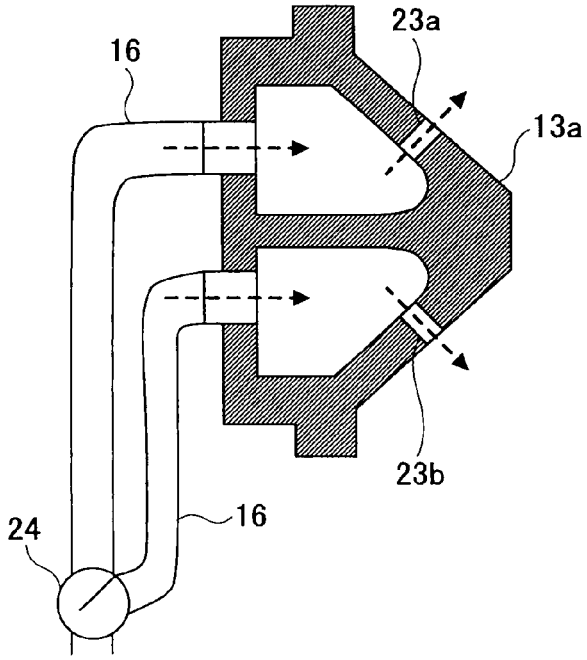
Figure 6:
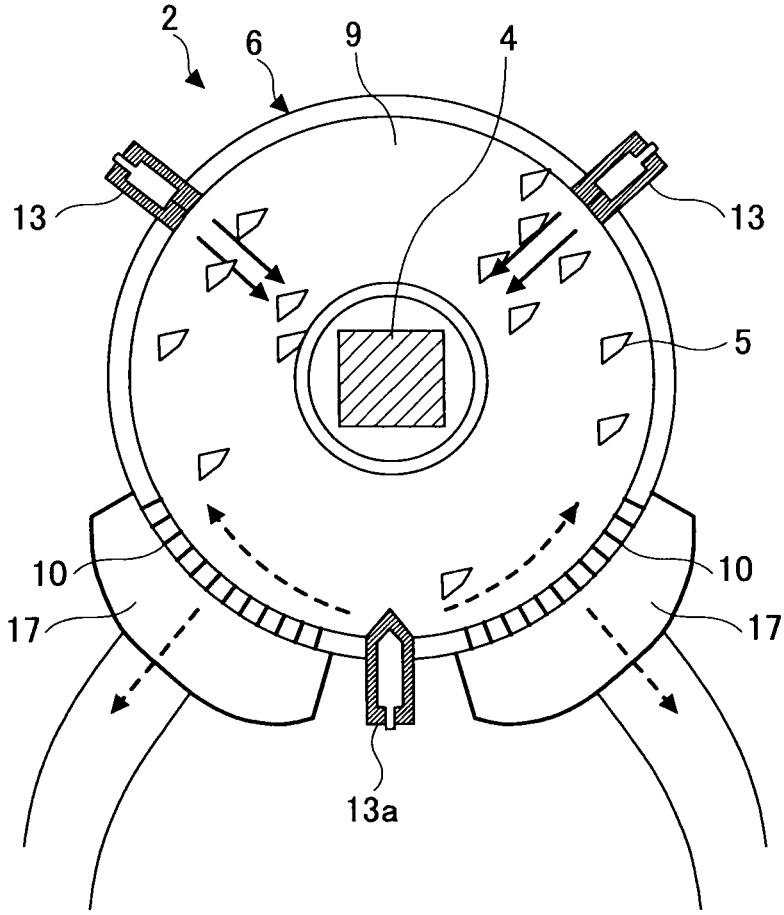
FIG. 6 is a configuration diagram of a dry-type cleaning apparatus having plural cleaning medium accelerating nozzles.

The above description has been made of the case of generating an air flow in a perpendicular upward direction in the cleaning medium flying space 9 from the cleaning medium accelerating nozzle 13. As shown in a front view of FIG. 5A and a cross-sectional view of FIG. 5B taken along a line A-A in FIG. 5A, a cleaning medium accelerating nozzle 13*a* having two systems of injecting holes 23*a* and 23*b* inclined at predetermined angles with respect to the perpendicular upward direction is provided at a bottom part of the cleaning tank 6. Pressurized air to be supplied to the two systems of the injecting holes 23*a* and 23*b* is switched by a switching valve 24 so as to generate an air flow along a cylindrical inner wall of the cleaning tank 6. The cleaning medium accelerating nozzle 13 may be provided for each path of air flows so that the cleaning medium 5 is caused to fly along the cylindrical inner wall of the cleaning tank 6 by an air flow alternately generated along the cylindrical inner wall of the cleaning tank 6 from the cleaning medium accelerating nozzle 13*a*. Then, the flying cleaning medium 5 may be collided with the object 4 to be cleaned by the air flow alternately injected from the cleaning medium accelerating nozzle 13.

In this manner, by alternately generating air flows at a certain cycle from the two systems of injecting holes 23*a* and 23*b* so as to collide the cleaning medium 5 flying along the cylindrical inner wall of the cleaning tank 6 with the object 4 to be cleaned by the air flow alternately injected from the cleaning medium accelerating nozzle 13, peaks and valleys of a surface of the object 4 to be cleaned, which has protrusions and recessions, can be cleaned. The whole surface of the object 4 to be cleaned having a complicated shape can be surely cleaned, and at the same time, a cleaning speed of the cleaning apparatus 1 can be improved.

In the above description, the two systems of the injecting holes 23*a* and 23*b* are provided for the cleaning medium accelerating nozzle 13*a*, however, one injecting hole 23 may be provided for the cleaning medium accelerating nozzle 13*a* and an angle of the cleaning medium accelerating nozzle 13*a* may be variably set. Moreover, a direction changing mechanism to change a direction of an injected air flow may be provided in the vicinity of the injecting hole 23. The direction changing mechanism may be formed by providing a flow control plate of which an angle is variable or plural injecting holes with different angles so that air flows are simultaneously generated and an angle of the air flow is changed by combining the air flows.

In the above description, the hollow elongated members 11*a* and 11*b* are provided at the opposing side walls of the cleaning tank 6. However, as shown in a cross-sectional view of FIGS. 7A and 7B, the hollow elongated member 11*a* may be connected to the opening of one of the side walls of the cleaning tank 6, while a deformable mechanism 25 formed of, for example, a flexible rubber film capable of deforming by a sufficient deforming amount with respect to the direct (linear) acting direction of the object 4 to be cleaned may be connected to the opening of the other side wall of the cleaning tank 6.

In this manner, in the cleaning apparatus 1 in which the hollow elongated member 11*a* is connected to the opening of one of the side walls of the cleaning tank 6 and the deformable mechanism 25 formed of a flexible rubber film is provided at the opening of the other side wall, the object 4 to be cleaned is inserted from the hollow elongated member 11 into the cleaning tank 6 in a state where a suction air flow is generated by the suction apparatus 18. When the object 4 to be cleaned is cleaned by the cleaning media 5 which are caused to fly by injecting an air flow from the cleaning medium accelerating nozzle 13, an influent air flow (which flows into the hollow elongated member 11*a*) is generated at an input slot of the hollow elongated member 11*a* connected to the opening of one of the side walls of the cleaning tank 6. The opening of the other side wall of the cleaning tank 6 is sealed with the deformable mechanism 25 formed of a flexible rubber film. The deformable mechanism 25 is deformed inward of the cleaning tank 6 due to the suction air flow of the suction apparatus 18. Thus, stagnation of the flying cleaning media 5 can be prevented. Therefore, the cleaning media 5 can be effectively used and a cleaning performance can be improved.

Figure 7A:
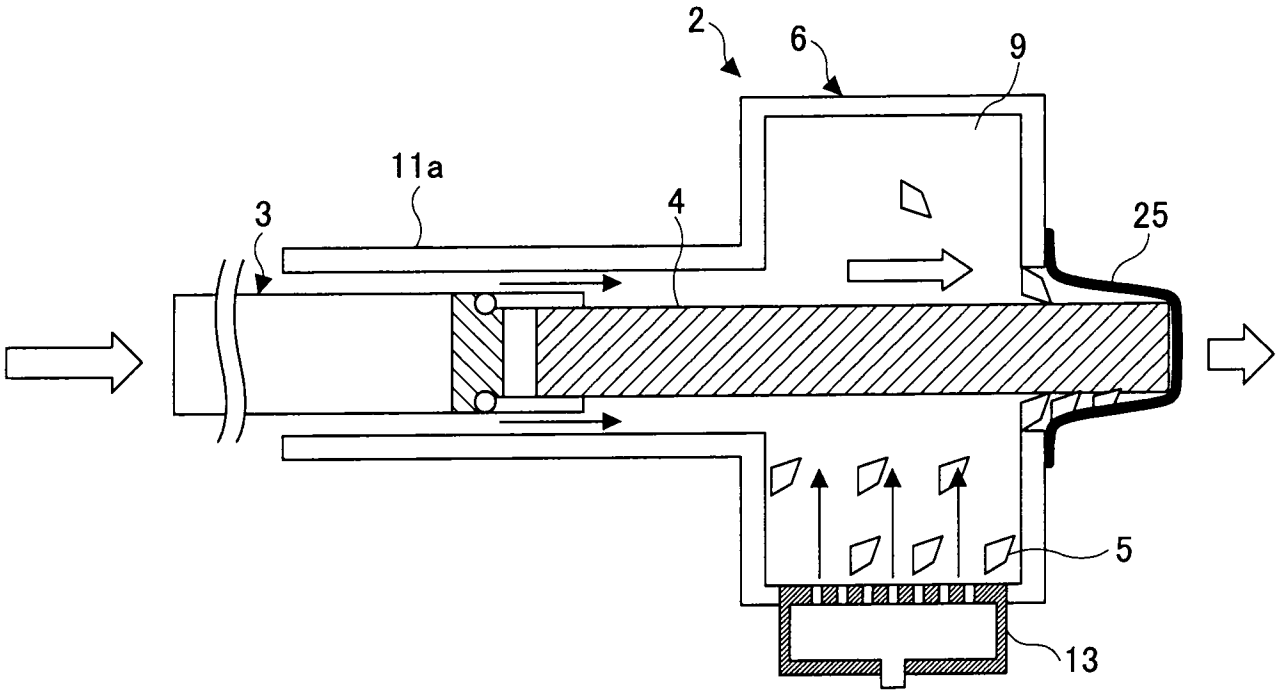
FIGS. 7A and 7B are configuration diagrams of a cleaning apparatus having a deformable mechanism at one opening of a cleaning tank.
Figure 7B:
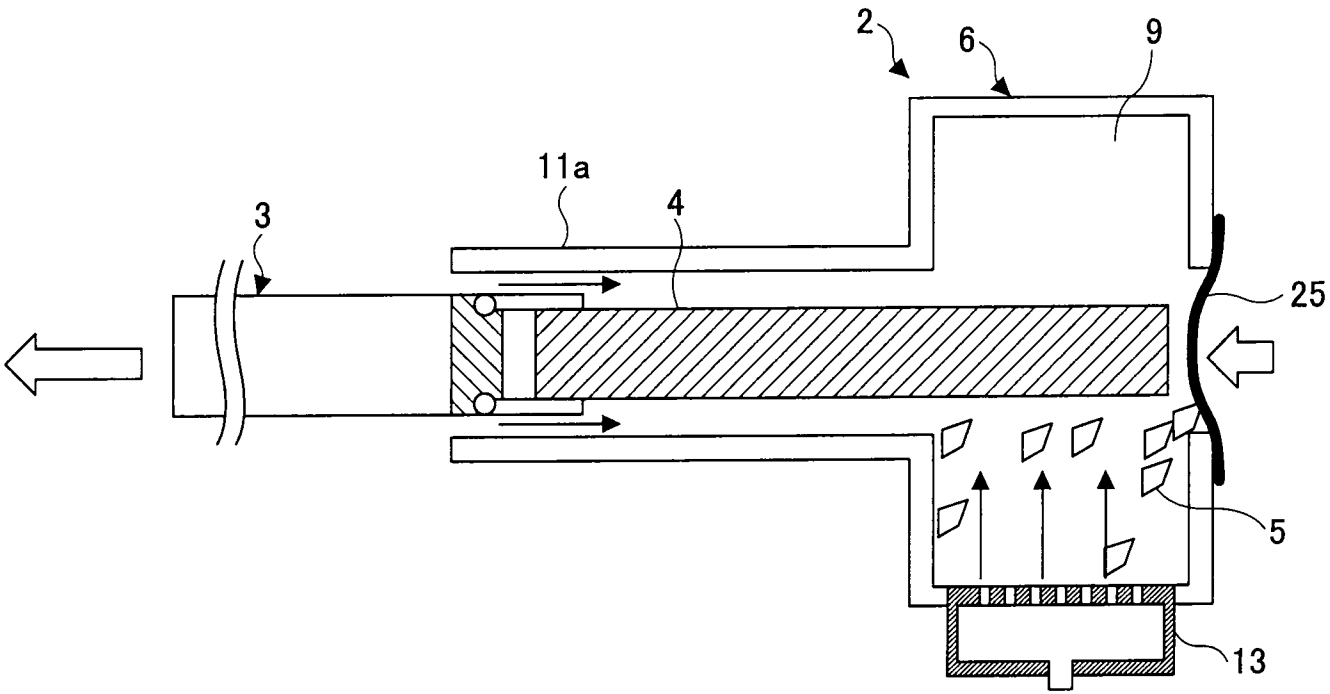

When the object 4 to be cleaned is further advanced in the cleaning apparatus 1 in this state, a leading end of the object 4 to be cleaned contacts the deformable mechanism 25 as shown in FIG. 7A and deforms the rubber film that constitutes the deformable mechanism 25. In this manner, by protruding (deviating) the leading end of the object 4 to be cleaned out of the cleaning tank 6, an end part of the object 4 to be cleaned on the holding part 3 side can be accommodated in the cleaning medium flying space 9 to be cleaned. After the whole surface of the object 4 to be cleaned is cleaned, injection of an air flow from the cleaning medium accelerating nozzle 13 is stopped and the object 4 to be cleaned is pulled back while the suction air flow is generated by the suction apparatus 18 in the cleaning tank 6. As shown in FIG. 7B, by the reversing of the object 4 to be cleaned, the deformable mechanism 25 is restored from the deformation by a negative pressure in the cleaning tank 6 and a restoring force of the rubber film which constitutes the deformable mechanism 25. At this time, the cleaning medium 5 stagnant between the object 4 to be cleaned and the rubber film constituting the deformable mechanism 25 can be returned into the cleaning tank 6. If necessary, after the whole surface of the object 4 to be cleaned is cleaned by repeating the advancements in back and forth directions and a stationary state of the object 4 to be cleaned, the object 4 to be cleaned is taken out of the cleaning tank 6, thereby the cleaning operation is completed.

Figure 8A:
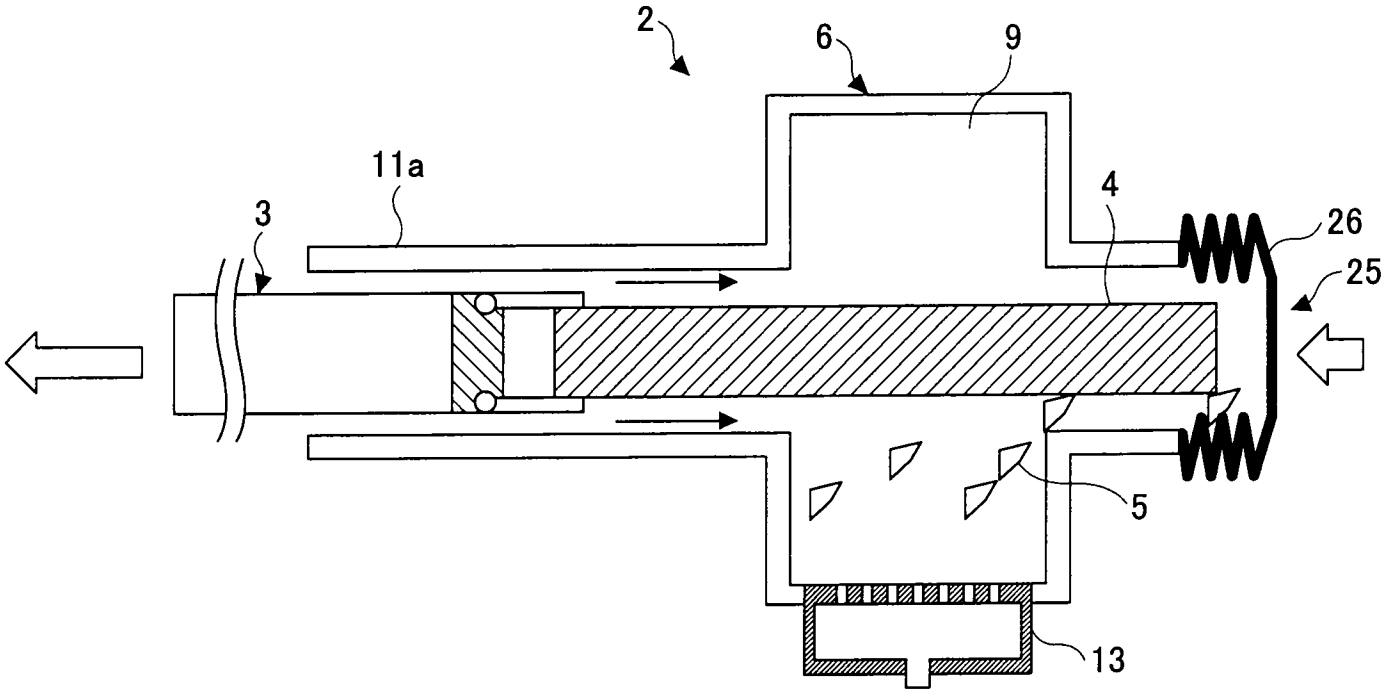
FIGS. 8A to 8C are configuration diagrams of cleaning apparatuses each having a different deformable mechanism at one opening of a cleaning tank.
Figure 8B:
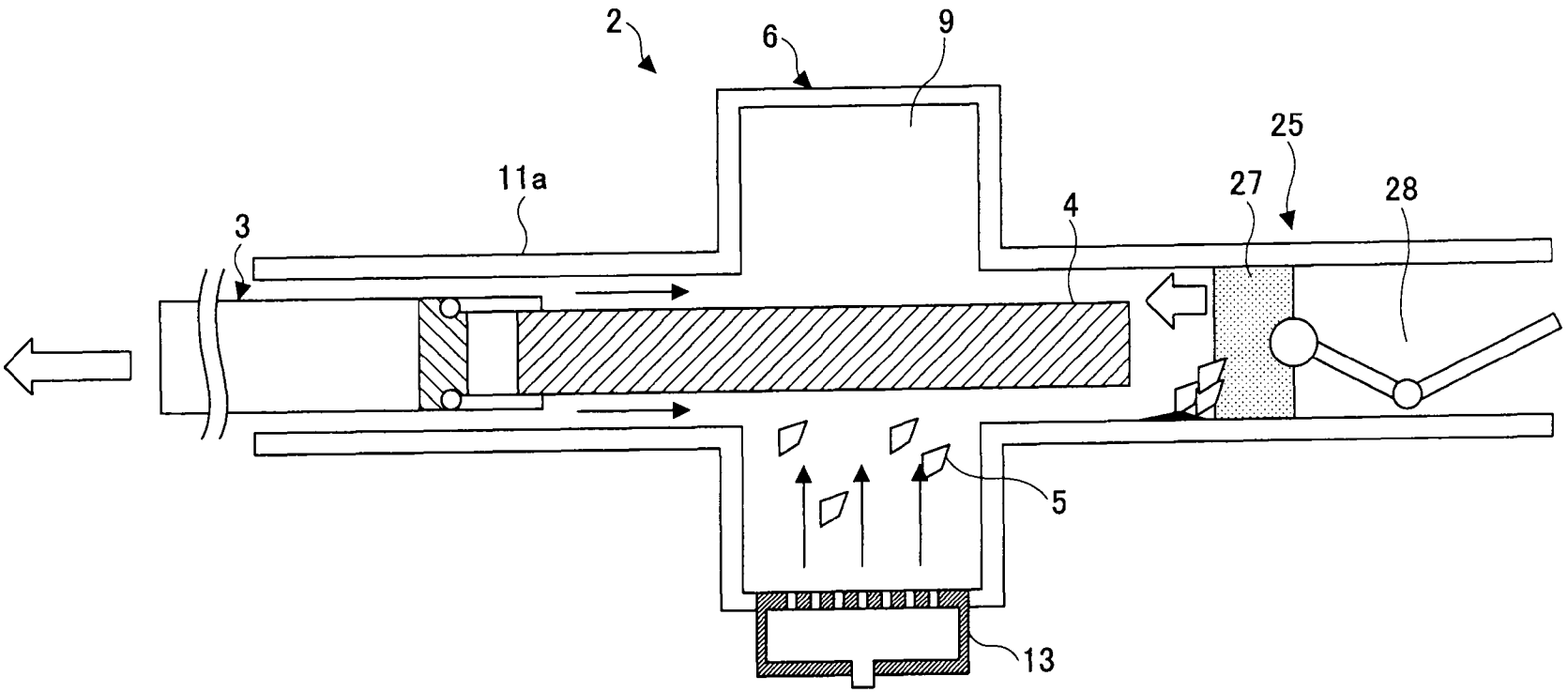
Figure 8C:
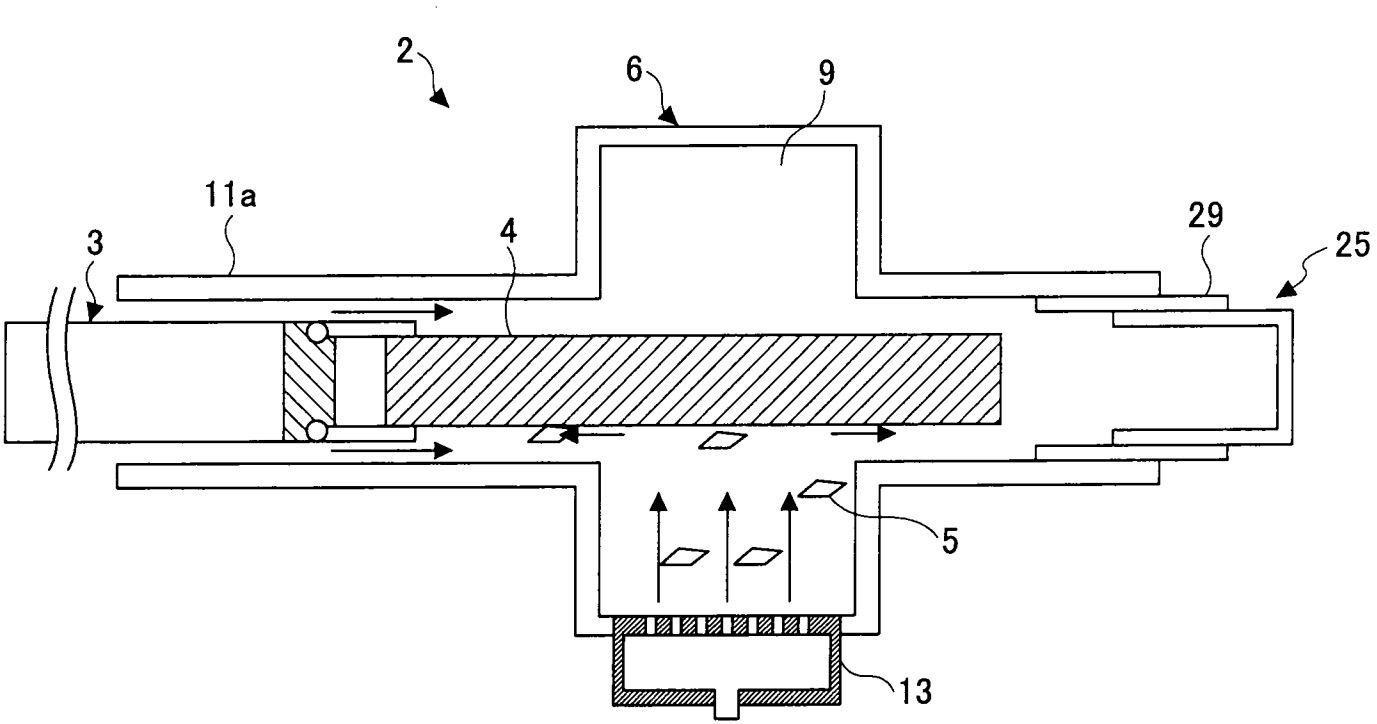

As the deformable mechanism 25 provided at a forward direction of the advancement of the object 4 to be cleaned in the cleaning tank 6, a cornice member 26 as shown in FIG. 8A, a crank mechanism 28 provided with a movable sealing member 27 as shown in FIG. 8B, or a connecting pipe member 29 which has a sealed outer end surface and is extendable in the forward direction of the advancement of the object 4 to be cleaned may be used to obtain a similar effect. Further, a driving part may be provided for the deformable mechanism 25 so as to control the deformation and movement of the deformable mechanism 25 in accordance with a position of the object 4 to be cleaned.

In this manner, by providing the deformable mechanism 25 in the forward direction of the advancement of the object 4 to be cleaned in the cleaning tank 6, the cleaning medium 5 can be caused to fly efficiently by preventing a leakage or stagnation of the cleaning medium 5. Further, the whole surface of the object 4 to be cleaned, which has a longer size than the cleaning tank 6, can be cleaned.

Figure 9:
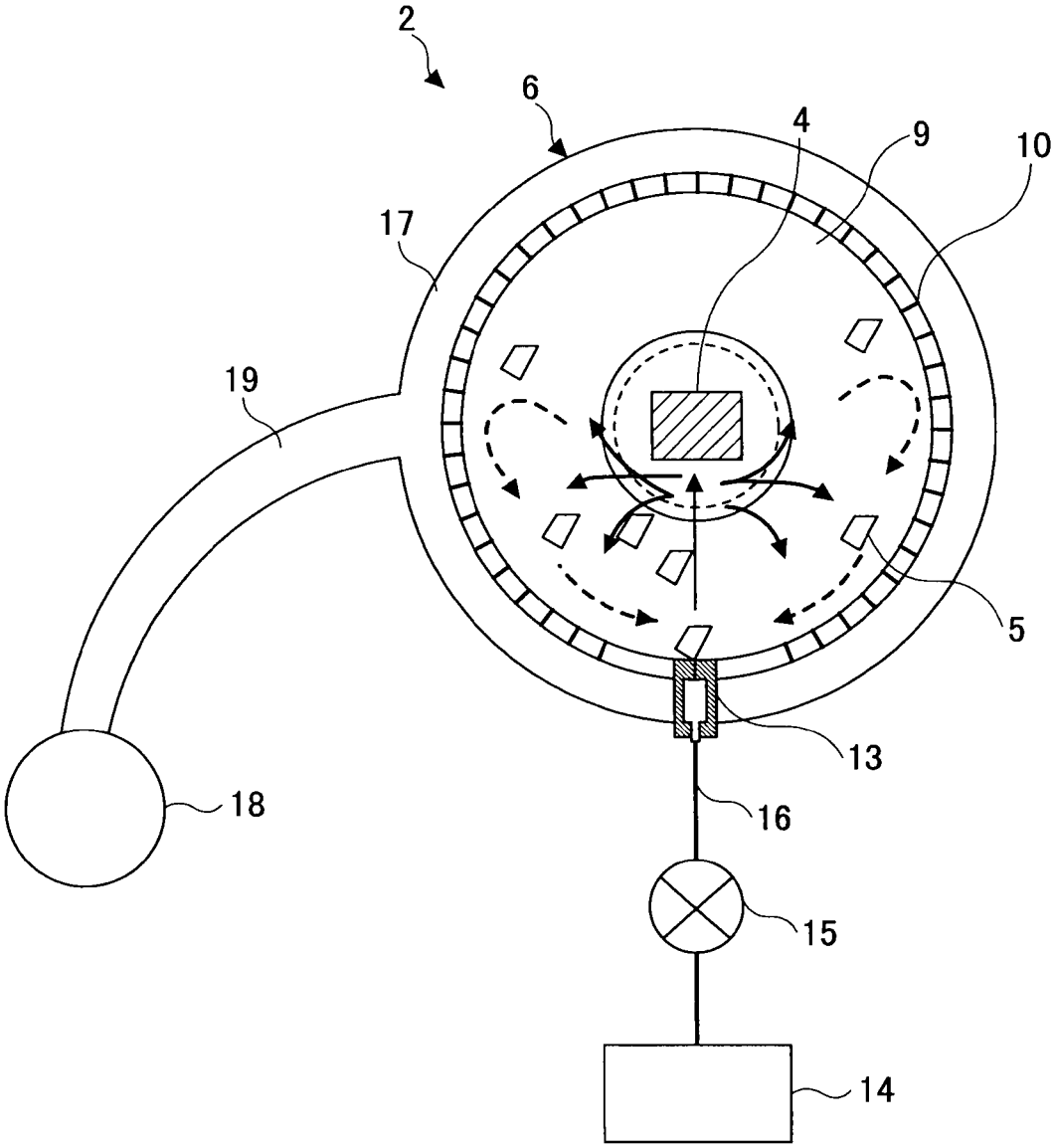
FIG. 9 is a configuration diagram of a cleaning apparatus having a separating part at a whole surface of a cleaning tank.

The description has been made on the case where the separating parts 10 are provided at the parts of the cylindrical wall of the cleaning tank 6 with a predetermined distance provided from the bottommost part of the cleaning tank 6. However, the separating part 10 may be provided along the entire surface of the cylindrical wall of the cleaning tank 6 and the suction duct 17 may be provided in an outer peripheral part of the separating part 10 as shown in a front cross-sectional view of FIG. 9. In this manner, by providing the separating part 10 along the entire surface of the cylindrical wall of the cleaning tank 6 so as to increase an area of the separating part 10 formed of a porous member, clogging of the separating part 10 can be prevented and a probability that the cleaning media 5 contact the separating part 10 can be increased. As a result, a deposit attached on the cleaning media 5 can be efficiently separated and the cleaning medium 5 from which a stain and the like are removed can be collided again with the object 4 to be cleaned. Thus, a cleaning efficiency of the cleaning apparatus 1 can be improved.

Figure 10:
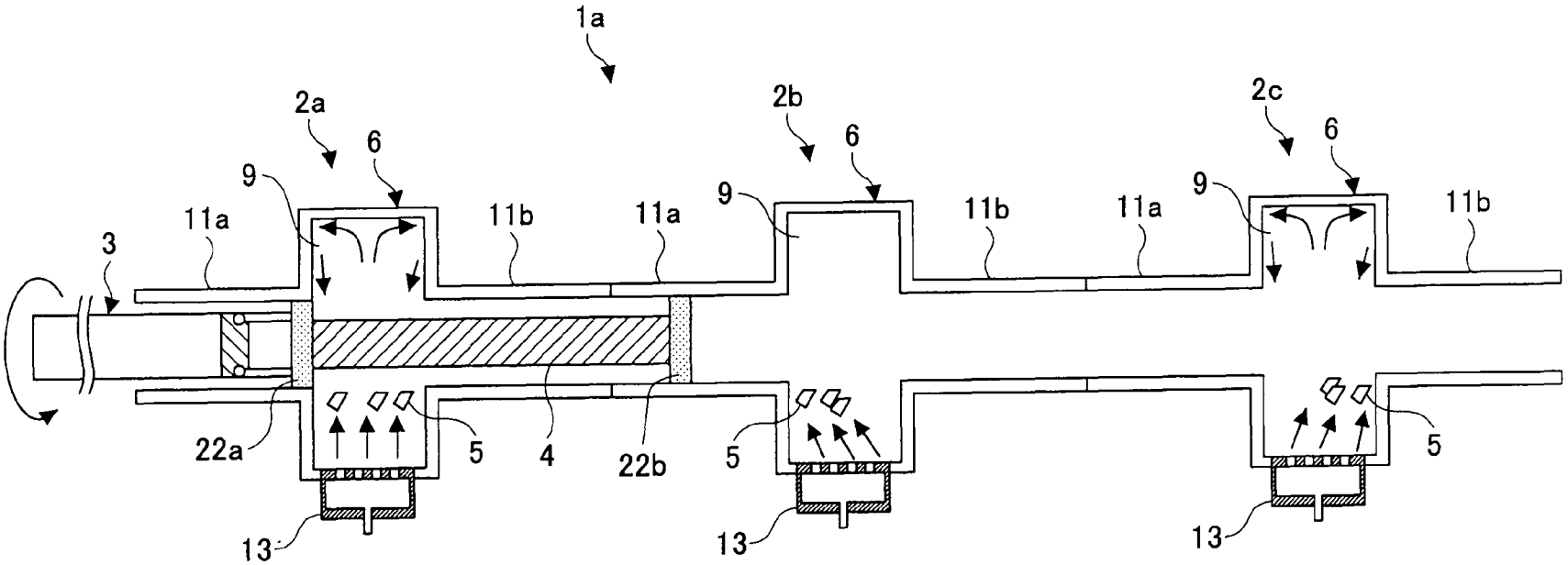
FIG. 10 is a configuration diagram of a cleaning apparatus in which plural cleaning tank units are provided in series.

In the above description, one set of the cleaning tank unit 2 is provided for the cleaning apparatus 1. A description is made below on a cleaning apparatus 1*a* provided with three sets of cleaning tank units 2*a* to 2*c* arranged in series as shown in a configuration diagram of FIG. 10.

The three respective sets of the cleaning tank units 2*a* to 2*c* have the hollow elongated members 11*a* and 11*b* connected to the opposing side walls of the respective cleaning tanks 6. The hollow elongated member 11*b* of the cleaning tank unit 2*a* and the hollow elongated member 11*a* of the cleaning tank unit 2*b* are connected to each other. In a manner similar to this, the hollow elongated member 11*b* of the cleaning tank unit 2*b* and the hollow elongated member 11*a* of the cleaning tank unit 2*c* are connected to each other. In this manner, the cleaning apparatus 1*a* is constituted.

Figure 11:
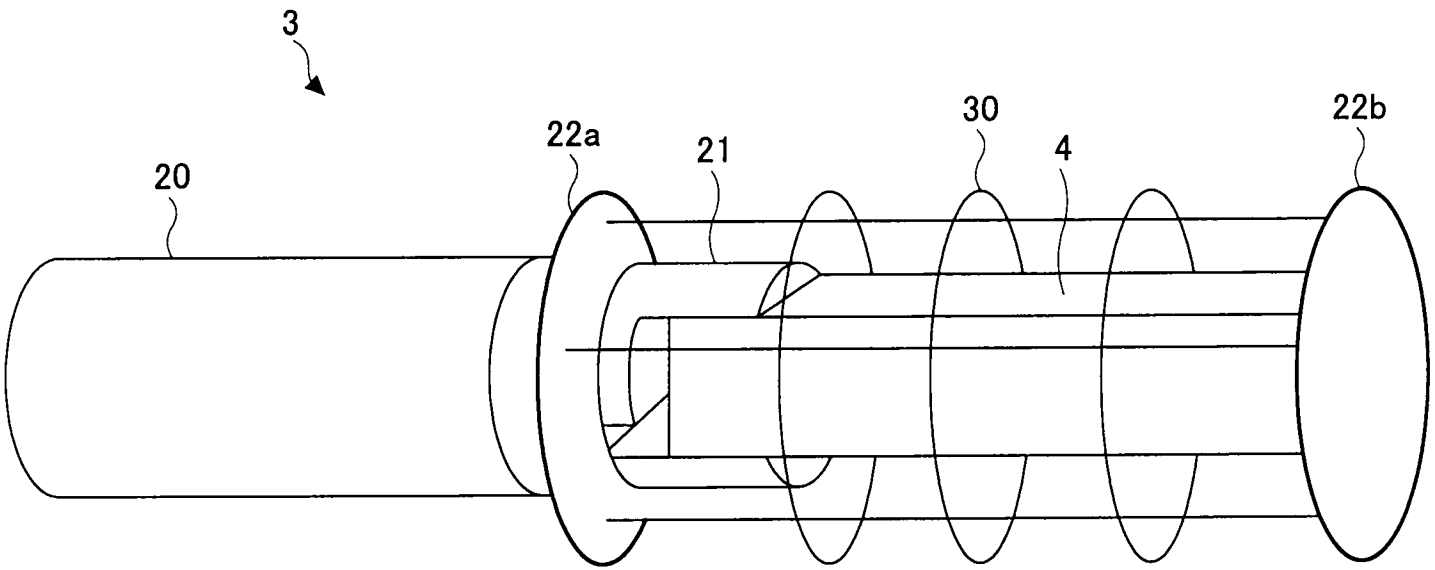
FIG. 11 is a perspective view showing another configuration of a holding part.

As shown in a perspective view of FIG. 11, the holding part 3 of the cleaning apparatus 1*a* includes the grip part 21, a wire frame 30, scraper parts 22*a* and 22*b*. The object 4 to be cleaned is fixed in the holding part 3 by the grip part 21. The wire frame 30 has openings in such a size that does not prevent the cleaning medium 5 from passing through. The scraper parts 22*a* and 22*b* have a feature to allow an air flow to pass through, but not to allow the cleaning medium 5 to pass through. The scraper parts 22*a* and 22*b* are connected to front and back of the wire frame 30 in a movement direction of the holding part 3.

The plural cleaning medium accelerating nozzles 13 provided for the cleaning tanks 6 of the cleaning tank units 2*a* to 2*c* can have different air injecting directions from each other with respect to the movement direction of the holding part 3. For example, the air injecting direction of the cleaning medium accelerating nozzle 13 of the cleaning tank unit 2*a* is set 90° with respect to the movement direction of the holding part 3. The air injecting direction of the cleaning medium accelerating nozzle 13 of the cleaning tank unit 2*b* is set to 120° with respect to the movement direction of the holding part 3. The air injecting direction of the cleaning medium accelerating nozzle 13 of the cleaning tank unit 2*c* is set to 60° with respect to the movement direction of the holding part 3. In this state, the holding part 3 holding the object 4 to be cleaned is moved from the cleaning tank 2*a* side. When the object 4 to be cleaned that is held by the holding part 3 is at positions of the cleaning tank units 2*a* to 2*c*, air flows are injected from the cleaning medium accelerating nozzles 13 of the cleaning tank units 2*a* to 2*c* to cause the cleaning media 5 to fly, thereby the object 4 to be cleaned is cleaned.

In this manner, by providing the plural cleaning tank units 2*a* to 2*c* in the cleaning apparatus 1*a* and setting the cleaning medium accelerating nozzles 13 of the cleaning tank units 2*a* to 2*c* to inject air flows at different angles from each other, the cleaning media 5 can be collided with the object 4 to be cleaned at the different directions even when the object 4 to be cleaned has a complicated shape with protrusions and recessions. As a result, the object 4 to be cleaned can be cleaned evenly. When there is a sufficient number of the cleaning tank units 2, the holding part 3 is not required to be reciprocated, but is only required to be driven in one direction to obtain a required cleaning result. In this case, moreover, the plural holding parts 3 holding the objects 4 to be cleaned can be inserted in succession to be cleaned. As a result, the plural objects 4 to be cleaned can be successively cleaned in a short time.

Further, the scraper parts 22*a* and 22*b* provided at front and back of the holding part 3 can prevent a part of the cleaning media 5 collided with the object 4 from being leaked outside the cleaning tank units 2*a* to 2*c*.

Moreover, when the holding part 3 advances straight, the scraper parts 22*a* and 22*b* pushes out the cleaning media 5 accumulated on the hollow elongated members 11*a* and 11*b*, thereby the cleaning media 5 can be collected into the cleaning tank 6. Accordingly, an amount of the cleaning media 5 flying in the cleaning tank 6 can be maintained to be constant, and the cleaning performance of the cleaning apparatus 1 can be improved.

According to at least one embodiment of the present invention, cleaning media can be caused to fly in a cleaning medium flying space without stagnation. Moreover, the cleaning performance can be maintained by effectively using the cleaning media and stabilizing the amount of flying cleaning media.

According to at least one embodiment, an object to be cleaned passes through a hollow elongated member and an opening for the object to be cleaned, is inserted at a position facing a cleaning medium accelerating part, and collided with the accelerated cleaning media to be cleaned. By placing the opening for the object to be cleaned at a position that does not face the cleaning medium accelerating part, a leakage of the cleaning media from the cleaning tank is suppressed. Further, by quickly collecting the cleaning media which have leaked into the hollow elongated member connected to the opening for the object to be cleaned into the cleaning tank by a cleaning medium returning part, the number of cleaning media in the cleaning tank is stabilized and the cleaning performance is maintained.

This patent application is based on Japanese Priority Patent Application No. 2008-158618 filed on Jun. 18, 2008, and Japanese Priority Patent Application No. 2009-111799 filed on May 1, 2009, the entire contents of which are hereby incorporated herein by reference.

What is claimed is:

1. A cleaning apparatus for cleaning an object to be cleaned by allowing a cleaning medium contained in the cleaning apparatus and caused to fly by an air flow to collide with the object to be cleaned, comprising:

a cleaning tank in which the cleaning medium is caused to fly by the air flow and which has an opening configured to allow the object to be cleaned to pass through;

a cleaning medium accelerating part provided at a bottom part of the cleaning tank and configured to inject the air flow to cause the cleaning medium to fly;

a suction part including suction ducts configured to remove dust or a deposit included in the air in the cleaning tank, a suction pipe configured to carry the air and/or the deposit sucked by the suction ducts and a suction apparatus configured to suck the air and/or the deposit in the cleaning tank through the suction pipe;

a hollow elongated member configured to have substantially the same inner diameter as a diameter of the opening of the cleaning tank, connected outside the opening of the cleaning tank, and configured to form a movement path for the object to be cleaned;

a cleaning medium returning part configured to return the cleaning medium stagnant in the hollow elongated member into the cleaning tank;

a holding part having a holder configured to hold the object to be cleaned and to move through the hollow elongated member to hold the object in the cleaning tank, the holding part configured to rotate the object around a rotational axis of the object; and a scraper member configured to seal a space formed between the hollow elongated member and the holding part and between the hollow elongated member and the object to be cleaned to prevent leak of the cleaning medium out of the apparatus, the scraper member being in a vicinity of the holder such that the scraper member is in contact with inner surfaces of the hollow elongated member, the scraper member including a brush configured to collect the cleaning medium that leaks into the hollow elongated member and to deposit the cleaning medium that leaks into the hollow elongated member into the cleaning tank, wherein in an opening in a side wall of the cleaning tank opposite the hollow elongated member, there is located either a second hollow elongated member also connected outside the opening of the cleaning tank and configured to have substantially the same inner diameter as the diameter of the opening of the cleaning tank and to form a movement path for the object to be cleaned, or a portable mechanism connected outside the opening of the cleaning tank and configured to deform by a deforming amount with respect to a movement direction of the object to be cleaned.

2. The cleaning apparatus as claimed in claim 1, wherein the cleaning tank has plural openings along the movement path in which the object to be cleaned moves.

3. The cleaning apparatus as claimed in claim 2, wherein the cleaning medium returning part is provided at one of said openings for the object to be cleaned and is deformable by stretching in the movement direction of the object to be cleaned in synchronization with the movement of the object to be cleaned.

4. The cleaning apparatus as claimed in claim 1, wherein the object to be cleaned is movable within the hollow elongated member and the hollow elongated member has a length equal to or more than a length of the object to be cleaned.

5. The cleaning apparatus as claimed in claim 1, further comprising, in the cleaning tank, a separating part which allows air or a removed stain to pass through but does not allow the cleaning medium to pass through, and a suction part connected to the separating part and configured to suck air from the cleaning tank.

6. The cleaning apparatus as claimed in claim 1, wherein the cleaning tank has a cleaning medium accelerating nozzle having plural injecting holes along the movement path in which the object to be cleaned moves.

7. The cleaning apparatus as claimed in claim 1, wherein the scraper member allows air flow to pass through to a peripheral surface but does not allow the cleaning medium to pass through.

8. The cleaning apparatus as claimed in claim 1, wherein the holder supports the object at only one end of the object.

* * * * *